United States Patent [19]

Sirko

[11] Patent Number: 4,952,091

[45] Date of Patent: Aug. 28, 1990

[54] GREETING CARD

[76] Inventor: Carol A. Sirko, 1761 S. Youngfield Ct., Lakewood, Colo. 80228

[21] Appl. No.: 445,037

[22] Filed: Dec. 4, 1989

[51] Int. Cl.[5] ..... B42F 5/00

[52] U.S. Cl. ..... 402/79; 281/2; 281/5; 402/80 R

[58] Field of Search ..... 281/27.1, 27.2, 27.3, 281/2, 5, 15.1, 38; 402/79, 80 R; 428/43, 192; 283/117, 116, 105; 40/124.1

[56] References Cited

U.S. PATENT DOCUMENTS

| | | | |
|---|---|---|---|
| 1,683,784 | 8/1927 | Plushkell | 281/27.3 |
| 1,805,268 | 5/1931 | Tresback | 281/27.3 |
| 1,976,198 | 10/1934 | Steenrod | 281/27.3 |
| 1,992,501 | 2/1935 | Newland et al. | 281/27.3 |
| 2,599,768 | 6/1952 | Losch | 281/27.3 |
| 3,467,479 | 9/1969 | Holes et al. | 402/79 |
| 4,789,187 | 12/1988 | Corlew et al. | 281/15.1 |
| 4,809,246 | 2/1989 | Jeng | 281/15.1 |
| 4,838,724 | 6/1989 | Spence | 402/79 |

*Primary Examiner*—Frank T. Yost
*Assistant Examiner*—Thomas Hamill, Jr.
*Attorney, Agent, or Firm*—H. Kenneth Johnston, II

[57] ABSTRACT

A greeting card having a message surface area and a retention strip extending past the edge of the card portion with ring receptors within the retention strip for placement in a ring binder and perforations parallel to and near the inner edge of the retention strip for either ease of folding into the card for mailing or removal of the retention strip from the card and mailing.

2 Claims, 1 Drawing Sheet

GREETING CARD

BACKGROUND OF THE INVENTION

The present invention relates to a greeting card capable of being mailed and retained in a ring binder by the receiver and sender.

Generally greeting cards are purchased, mailed, received, read and disposed of or saved by the receiver cluttering up drawers, boxes or other storage mediums.

Retention of greeting cards has always been bulky, messy or, in the least, substantially cluttering of ones records as there has been no reasonable means of saving these cards from special friends.

Individuals spend extensive amounts of time finding cards with the right inscription or drafting their own only to have them discarded by the receiver because they have no reasonable means of retaining them without substantial effort on their part.

The present invention eliminates this problem and in fact reduces both, the receivers and senders storage difficulties. Individuals wanting to send cards generally have to go to a gift shop whenever they have a need for a greeting card unless they are willing to keep boxes of cards stored. In the within invention, an individual may sort through a group of cards in a ring binder and select the card that is desirable for the occasion without the necessity of making a trip to a gift shop. The sender may send the selected card to the friend leaving the holed retention strip attached in order that the receiving friend may retain the card for posterity. In another situation the individual may select a card, remove the retention strip and, mail the card to the recipient as there probably would not be retention of the cards, such as in the case of casual acquaintances.

The present invention allows an individual to purchase numerous different cards when shopping and inserting them into a ring binder until an occasion arises for their use. The cards are kept neat in the binder and are always there for easy access.

The prior art of which the applicant is aware are as follows:

U.S. Pat. No. 930,290 1909, Holm discloses a postal card having a plurality of enclosed pictures adapted to be viewed in book-like form.

U.S. Pat. No. 764,701 1904, Ayres discloses a detachable book leaf to enable one to use the full ledger page.

U.S. Pat. No. 1,172,010 1916, Cooke discloses loose leaf book having multiple holes in the leaves in order to rotate them in the book when the leaves are torn from the perforations.

U.S. Pat. No. 725,963 1903, Hoffmann discloses having a detachable cover over the postal card.

U.S. Pat. No. 1,428,102 1922, Kelly discloses a detachable invoice sheet with rounded corners for easy and repeated insertion into a typewriter.

U.S. Pat. No. 817,663 1906, Pifer discloses a photographic postal mailing card with a positive picture produced in the camera.

U.S. Pat. No. 2,522,256 1948, Craft discloses a mailer utilizing normal lined sheets with a holed cover capable of being sealed on itself and mailed.

U.S. Pat. No. 2,262,347 1939 Sturc discloses a post card which has adhesive inorder that the card may be folded in half, affixed to itself and mailed with the written message inside the folded area.

U.S. Pat. No. 4,589,590 1986, Mc Guire discloses a multiple post card as direct mail advertising.

The instant invention relates to a greeting card which can be easily stored by the sender and receiver alike by the retention of the retention strip or mailed as any other greeting card by removing the retention strip and is easily distinguished from the forgoing teachings. The within invention has easy access to a specific card by merely flipping through the binder notebook which may be indexed for the purposes of a choice of a card to send or reminisce of cards received.

SUMMARY OF THE INVENTION

A greeting card of this invention provides a unique card which allows easy success for both the sender or receiver to review the cards by retaining the rentention strip and storage in a ring binder. The sender may review cards in his/her file and pick a particular card suited for the occassion, remove from the ring binder, fold the retention strip in/or out along the parallel row of perforations and after writing a suitable message, mailing the card. The receiver then opens the envelope, removes the card, unfolds the retention strip and after reading the message and inscription files the card in a ring binder for later review.

In another embodiment of the invention, the retention strip may be removed from the card and mailed similarily to other greeting cards on the market.

BRIEF DESCRIPTION OF THE DRAWINGS

FIG is front perspective view of the greeting card showing the attached retention strip.

DESCRIPTION OF THE PREFERRED EMBODIMENT

Figure 1:
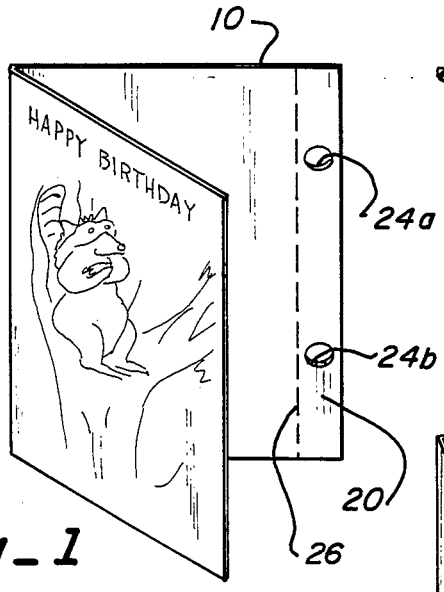

Referring to the drawings, FIG. 1 depects greeting card 10 with retention strip 20 and ring receptions 24*a* and 24*b*.

Figure 2:
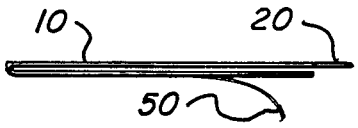
FIG. 2 is a top view of the greeting card showing the greeting card in the closed position and the retention strip attached and folded in a mailing position.

When a greeting card 10 has been selected and the sender decides to send the greeting card 10 which may be retained by the receiver, retention strip 20 is folded either into the greeting card 10 or outwardly as shown in FIG. 2. Greeting card 10 may be coated with a thin plastic film 50 so capable of being written on and adding to the durability of the greeting card 10 as further shown in FIG. 2.

Figure 3:
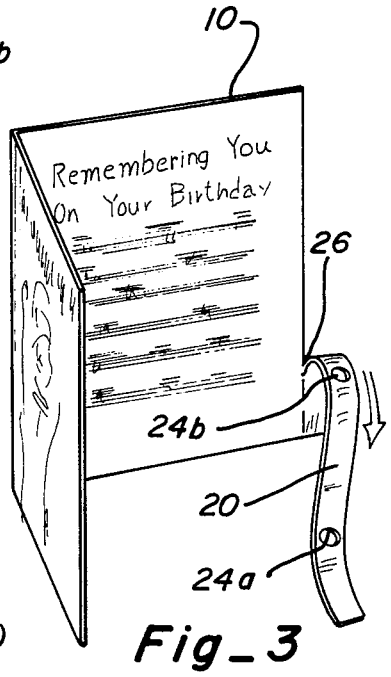
FIG. 3 is a front perspective view of the greeting card of FIG. 1 showing retention strip partially removed.

It is understood that not every person that would be sent a greeting card 10 would be an individual that a sender would want or anticipate that the recipient would want to retain the greeting card 10. Therefore, the sender would remove the retention strip 20 along perforations 26 as shown in FIG. 3 and simply mail the card.

Figure 4:
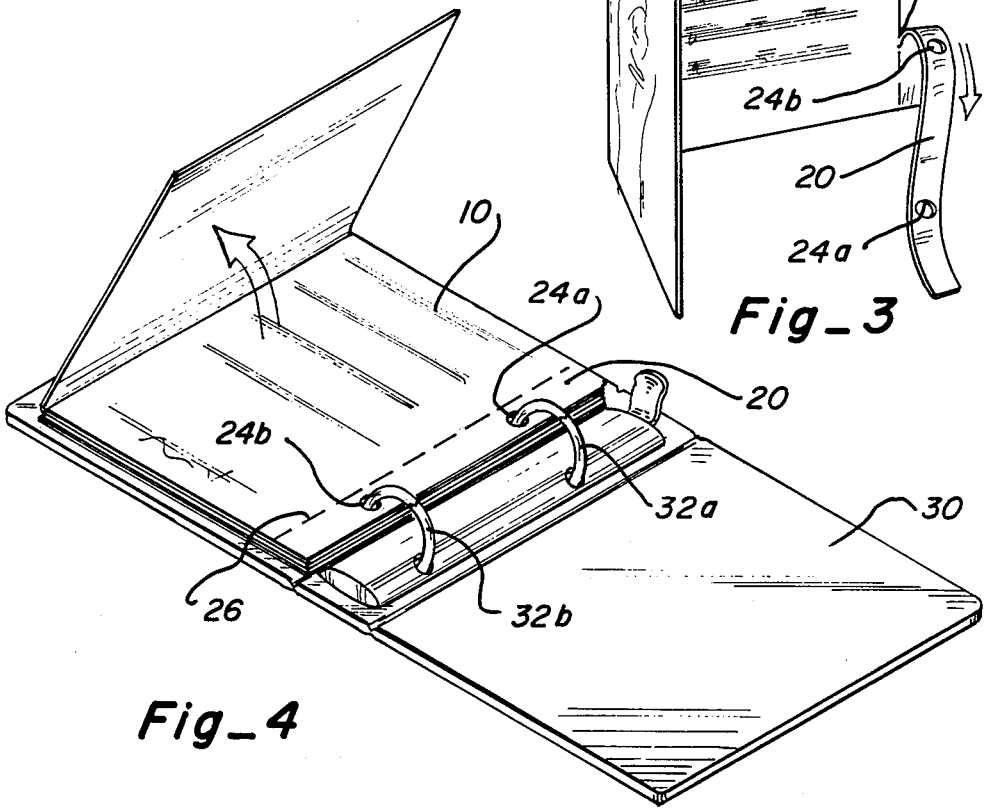
FIG. 4 is the perspective view of the greeting card of FIG. 1 retained in a ring binder by the retention strip.

A greeting card 10, which is received having the retention strip 20 in place may be kept in ring binder 30 by placing the ring receptors 24*a* and 24*b* on rings 32*a* and 32*b* and review as often as desired by the receiver as shown in FIG. 4.

Perforations 26 may be either mechanically made or electronically made such as a laser cut to provide a smooth edge upon the removal of the retention strip 20.

While specific embodiments of the present invention have been shown and described in detail to illustrate the utilization thereof, it is understood that it may be modified without deviating from the spirit of the invention.

What I claim is:

1. A multiple page message card having pre-printed indicia thereon comprising:

a front page and a back page contiguous with each other at a fold;

said multiple page messages adapted to receive a senders message placed thereon;

said back page having a retention strip;

said retention strip extending outwardly along the outer most part of said back page and parallel to said fold;

said retention strip separated from said back page by a perforation means running parallel to said fold and the length of said retention strip;

said retention strip having a ring receptor means for retaining said multiple page message card in a binder notebook;

said retention strip may be removed or folded into said multiple page message card along said perforation means to provide a sender a multiple page message card capable of fitting into a standard multiple page message card envelope.

2. A multiple page message card of claim 1 wherein said ring receptor means is two ring receptors.

* * * * *